US011346364B2

(12) United States Patent
Kunishi et al.

(10) Patent No.: US 11,346,364 B2
(45) Date of Patent: May 31, 2022

(54) MULTISTAGE CENTRIFUGAL FLUID MACHINE

(71) Applicant: Hitachi Industrial Products, Ltd., Tokyo (JP)

(72) Inventors: Hayato Kunishi, Tokyo (JP); Tomohiro Naruse, Tokyo (JP); Takeshi Kazama, Tokyo (JP); Kazuo Takeda, Tsuchiura (JP); Hiroaki Yoshimura, Tokyo (JP)

(73) Assignee: Hitachi Industrial Products, Ltd., Tokyo (JP)

( * ) Notice: Subject to any disclaimer, the term of this patent is extended or adjusted under 35 U.S.C. 154(b) by 127 days.

(21) Appl. No.: 16/643,657

(22) PCT Filed: Mar. 5, 2018

(86) PCT No.: PCT/JP2018/008242
§ 371 (c)(1),
(2) Date: Mar. 2, 2020

(87) PCT Pub. No.: WO2019/049398
PCT Pub. Date: Mar. 14, 2019

(65) Prior Publication Data

US 2020/0271126 A1 Aug. 27, 2020

(30) Foreign Application Priority Data

Sep. 6, 2017 (JP) ..... JP2017-170857

(51) Int. Cl.
*F04D 29/42* (2006.01)
*F04D 1/08* (2006.01)
*F04D 17/12* (2006.01)

(52) U.S. Cl.
CPC ..... *F04D 29/42* (2013.01); *F04D 1/08* (2013.01); *F04D 17/12* (2013.01); *F05D 2230/60* (2013.01); *F05D 2240/14* (2013.01)

(58) Field of Classification Search
CPC .. F04D 17/12; F04D 29/4206; F04D 29/4226; F04D 29/62; F04D 29/624;
(Continued)

(56) References Cited

U.S. PATENT DOCUMENTS 2,404,783 A * 7/1946 Blom ..... H02K 5/132 417/414
4,579,509 A 4/1986 Jacobi
(Continued)

FOREIGN PATENT DOCUMENTS

JP 51-325 B2 1/1976
JP 58-75994 U 5/1983
JP 60-67797 A 4/1985
JP 6-83988 U 12/1994
(Continued)

OTHER PUBLICATIONS

International Search Report (PCT/ISA/210) issued in PCT Application No. PCT/JP2018/008242 dated May 29, 2018 with English translation (five pages).
(Continued)

*Primary Examiner* — Eldon T Brockman
*Assistant Examiner* — Brian O Peters
(74) *Attorney, Agent, or Firm* — Crowell & Moring LLP

(57) ABSTRACT

There is provided a multistage centrifugal fluid machine capable of improving efficiency of an operation for assembling an inner casing to a high pressure side head flange. The multistage centrifugal fluid machine 100 includes a rotor 3 provided with a plurality of impellers (41 to 81) in an axial direction, a cylindrical outer casing 2, and an inner bundle 1 that is fitted with the outer casing 2 to form a flow passage for the working fluid. The inner bundle 1 includes a high pressure side head flange 11, a low pressure side head flange 12, and an inner casing 5 disposed between the high pressure side head flange 11 and the low pressure side head flange 12.
(Continued)

The high pressure side head flange 11 and the inner casing 5 are fastened with a first bolt 142 via an elastic body 144.

9 Claims, 7 Drawing Sheets

(58) Field of Classification Search
CPC ..... F01D 25/243; F01D 25/246; F01D 25/26; F05D 2230/60; F05D 2240/14
See application file for complete search history.

(56) References Cited

U.S. PATENT DOCUMENTS

| | | | | |
|---|---|---|---|---|
| 4,961,260 | A | 10/1990 | Ferri et al. | |
| 6,398,484 | B1 * | 6/2002 | Orikasa | F04D 17/122 415/112 |
| 2016/0153293 | A1 * | 6/2016 | Mori | F01D 25/26 415/191 |

FOREIGN PATENT DOCUMENTS

| | | | |
|---|---|---|---|
| JP | 2003-269390 | A | 9/2003 |
| JP | 2014-206132 | A | 10/2014 |
| WO | WO 2016177880 | * | 11/2016 |

OTHER PUBLICATIONS

Japanese-language Written Opinion (PCT/ISA/237) issued in PCT Application No. PCT/JP2018/008242 dated May 29, 2018 (five pages).

* cited by examiner

MULTISTAGE CENTRIFUGAL FLUID MACHINE

TECHNICAL FIELD

The present invention relates to a uniaxial multistage centrifugal fluid machine such as a pump and a compressor, and particularly, to a structure of an inner bundle of the multistage centrifugal fluid machine.

BACKGROUND ART

The uniaxial multistage centrifugal fluid machine has been known as disclosed in PTL 1. The multistage centrifugal fluid machine disclosed in PTL 1 includes a cylindrical outer casing, and an inner casing that is fitted with the outer casing so that a working gas flow passage is defined by the inner casing and a rotor. The inner casing is fixed to one end of the outer casing with a share key. An inner barrel of the inner casing is constituted by a first group inner barrel and a second group inner barrel. Each of the first group inner barrel and the second group inner barrel is fastened with tie-bolts circumferentially disposed at a plurality of positions.

PTL 1 discloses that the grooves formed in the outer circumferences of the respective group inner barrels are connected with a plurality of connecting members. The connecting member with an inverted U-like cross section has a bolt-through portion at one side, and a fitting portion at the other side, while having a horizontal section extending therebetween. The bolt-through portion is fitted with a fitting portion as a deep groove of the inner barrel member of the first group inner barrel. The horizontal section extends across the two inner barrel members. In the disclosure, the fitting portion is fitted with a fitting portion as a deep groove of the inner barrel member of the second group inner barrel.

CITATION LIST

Patent Literature

PTL 1: Japanese Unexamined Patent Application Publication No. 2014-206132

SUMMARY OF INVENTION

Technical Problem

In PTL 1, the inner casing stored inside the barrel type casing is divided into two groups in an axial direction. The connecting members are disposed to fit those groups while leaving a gap equal to or greater than a manufacturing error in the axial direction between those groups. However, a backlash owing to the gap may cause the risk of taking time for performing assembly (assembling operation) of the inner casing constituted by the two groups fitted with the connecting members to the high pressure side head flange. It is therefore difficult for the structure as disclosed in PTL 1 to improve efficiency in the assembling operation.

It is an object of the present invention to provide a multistage centrifugal fluid machine that ensures to improve efficiency in assembling the inner casing with the high pressure side head flange.

Solution to Problem

In order to solve the above-described problem, the multistage centrifugal fluid machine according to the present invention includes at least a rotor provided with a plurality of impellers in an axial direction, a cylindrical outer casing, and an inner bundle that is fitted with the outer casing to form a flow passage for a working fluid. The inner bundle includes a high pressure side head flange, a low pressure side head flange, and an inner casing disposed between the high pressure side head flange and the low pressure side head flange. The high pressure side head flange and the inner casing are fastened with a first bolt via an elastic body.

The multistage centrifugal fluid machine of another type according to the present invention includes at least a rotor provided with a plurality of impellers in an axial direction, a cylindrical outer casing, and an inner bundle that is fitted with the outer casing to form a flow passage for a working fluid. The inner bundle includes a high pressure side head flange, a low pressure side head flange, and a plurality of inner barrel members. The inner barrel members are formed of a first group inner barrel member and a second group inner barrel member. The first group inner barrel member and the second group inner barrel member are adjacent to each other in the axial direction, and fastened with a first bolt via an elastic body.

Advantageous Effects of Invention

The present invention is capable of providing a multistage centrifugal fluid machine that ensures to improve efficiency in assembling the inner casing with the high pressure side head flange.

The problems, structures, and effects other than those described above will be clarified by explanations of the examples as described below.

DESCRIPTION OF EMBODIMENTS

Figure 1:
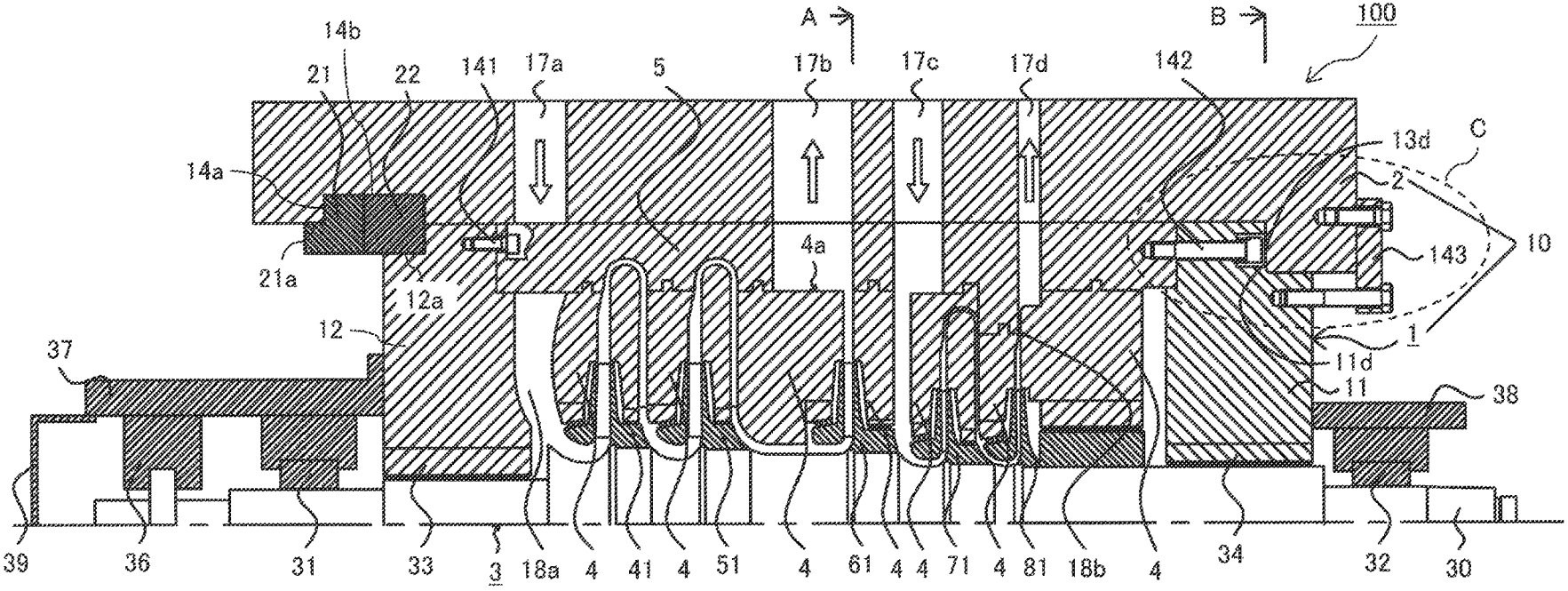
FIG. 1 is a longitudinal sectional view of a multistage centrifugal fluid machine as Example 1 of an embodiment according to the present invention.

In the specification the "multistage centrifugal fluid machine" represents a multistage centrifugal compressor with a rotor provided with a plurality of impellors in an axial direction, and a pump as well. The "working fluid" refers to a working gas used for the multistage centrifugal compressor as the multistage centrifugal fluid machine, and to a working liquid used for the pump as the multistage centrifugal fluid machine. The multistage centrifugal compressor will be described hereinafter as an example of the multistage centrifugal fluid machine.

Examples according to the present invention will be described referring to the drawings.

Example 1

FIG. 1 is a longitudinal sectional view of the multistage centrifugal fluid machine as Example 1 of an embodiment according to the present invention, that is, the longitudinal sectional view of the multistage centrifugal fluid machine (multistage centrifugal compressor) 100 with a barrel type casing 10. Referring to FIG. 1, each void arrow indicates the flow direction of the working fluid (working gas). As FIG. 1 shows, a rotary shaft 30 is provided with a plurality (for example, five as shown in FIG. 1) of impellers (41, 51, 61, 71, 81) to constitute a rotor 3. A pair of radial bearings 31, 32 are disposed at the respective shaft ends of the rotary shaft 30. A thrust bearing 36 is further disposed closer to the shaft end than the radial bearing 31. The radial bearings 31, 32 rotatably bear the rotary shaft 30. The thrust bearing 36 bears the thrust load applied to the rotor 3. The radial bearings 31, 32, and the thrust bearing 36 are attached to bearing supports 37, 38, respectively. The section closer to the shaft end than the thrust bearing 36 is covered with a cover 39.

Seal sections 33, 34 are disposed between the radial bearings 31, 32 and the impellers (41, 51, 61, 71, 81) for preventing external leakage of the high pressure working fluid (working gas) that has been compressed in the rotor 3. The seal gas is supplied from outside by an unshown gas seal section to the seal sections 33, 34.

The multistage centrifugal fluid machine (multistage centrifugal compressor) 100 configured as a double shell barrel type casing 10 includes an inner bundle 1 and an outer casing 2. The outer casing 2 has a suction flow passage 17*a* for supplying the working fluid (working gas) from an unshown suction nozzle to a first-stage impeller 41, and a discharge flow passage 17*d* for discharging the compressed working fluid (working gas) outside the multistage centrifugal fluid machine (multistage centrifugal compressor) 100 from a last-stage impeller 81 via an unshown discharge nozzle. The outer casing further has a discharge flow passage 17*b* for discharging the compressed working fluid (working gas) in the intermediate stage for cooling purpose, and a suction flow passage 17*c* for returning the working fluid (working gas) into the multistage centrifugal fluid machine (multistage centrifugal compressor) 100.

More specifically, the working fluid (working gas) flows into the first-stage impeller 41 via the suction flow passages 17*a* and 18*a*. The working fluid is compressed by the first-stage impeller 41, and flows into a return channel as the flow directed radially inward from the U-shaped flow passage via a diffuser and a diffuser flow passage, which are formed radially outward at the downstream side of the impeller 41. An innermost diameter side of the return channel is formed as a suction flow passage of the impeller 51 that constitutes the compressor at the subsequent stage. The working fluid (working gas) flows into the impeller 51 constituting the second-stage compressor via the above-described suction flow passage. The high pressure working fluid (working gas) compressed by the impeller 51 flows into the return channel via the second-stage diffuser and the diffuser flow passage. The innermost diameter side of the return channel is formed as the suction flow passage of the impeller 61 constituting the compressor at the subsequent stage. The working fluid (working gas) flows into the impeller 61 that constitutes the third-stage compressor via the above-described suction flow passage. The high pressure working fluid (working gas) compressed by the impeller 61 is discharged outside from the discharge flow passage 17*b* via the third-stage diffuser and the diffuser flow passage.

The high pressure working fluid (working gas) that has been cooled outside the machine flows into the impeller 71 constituting the fourth-stage compressor via the suction flow passage 17*c*. The high pressure working fluid (working gas) compressed by the impeller 71 flows into the return channel via the diffuser and the diffuser flow passage. The innermost diameter side of the return channel is formed as the suction flow passage of the impeller 81 constituting the compressor at the subsequent stage. The working fluid (working gas) flows into the last-stage impeller 81 constituting the last-stage compressor via the above-described suction flow passage. The high pressure working fluid (working gas) compressed by the impeller 81 is discharged outside the multistage centrifugal fluid machine (multistage centrifugal compressor) 100 from the discharge flow passage 17*d*. In the example, five impellers are attached to the rotary shaft 30 as an exemplified case. However, the number of the impellers to be axially attached to the rotary shaft 30 is not limited to the number as described above.

The inner bundle 1 forms the flow passages for the working fluid (working gas) in the multistage centrifugal fluid machine (multistage centrifugal compressor) 100 together with the rotor 3. The inner bundle 1 includes a low pressure side head flange 12 that forms the suction flow passage 18*a* toward the first-stage impeller 41, and a high pressure side head flange 11 that forms the discharge flow passage at both shaft ends, respectively. An inner barrel member 4 is disposed between the high pressure side head flange 11 and the low pressure side head flange 12 for forming the flow passages (the diffuser flow passage and the return channel as described above) guiding the flow from the impeller to the one at the subsequent stage. The inner barrel member 4 is of horizontal two-divided type. Each of the horizontally divided inner barrel members 4 is axially divided into a plurality of sections. The respective inner barrel members axially disposed on the rotor 3 are integrated through spigot fitting to the inner casing 5. An unshown drive unit such as an electric motor (motor) for rotatably driving the rotor 3 is disposed at one side of the two head flanges either the high pressure side head flange 11 or the low pressure side head flange 12.

Lock members referred to as a first share key 21 and a second share key 22 are used for stably retaining the inner bundle 1 with the outer casing 2. The use of the first share key 21 and the second share key 22 as the lock members forms a stepped portion (step) 12*a* on an outer circumference of the low pressure side head flange 12 constituting the inner bundle 1 at the end outside the machine. A groove 14*b* is formed in the inner circumferential surface of the outer casing 2 at the side of the thrust bearing 36, corresponding to the stepped portion (step) 12*a*. The groove 14*b* formed in the inner circumferential surface of the outer casing 2, and the stepped portion (step) 12*a* formed on the outer circumference of the low pressure side head flange 12 at the end outside the machine are locked with the arc-shaped first share key 21 and the second share key 22 at a plurality of points in the circumferential direction. The second share key 22 locks both the groove 14*b* and the stepped portion (step) 12*a*. Meanwhile, the first share key 21 connected to the second share key 22 has a stepped shape so that a stepped portion (step) 21*a* locks a corner 14*a* of the groove 14*b* of the outer casing 2.

A stepped portion (step) 13*d* (second step) formed on the inner circumferential surface of the outer casing 2 at the side of the high pressure side head flange 11 is spigot fitted with a positioning portion (step) 11*d* (first step) of the high pressure side head flange 11 constituting the inner bundle 1. The spigot fitted portion positions the inner bundle 1 and the outer casing 2 axially in cooperation with the first share key 21 and the second share key 22.

Figure 2:
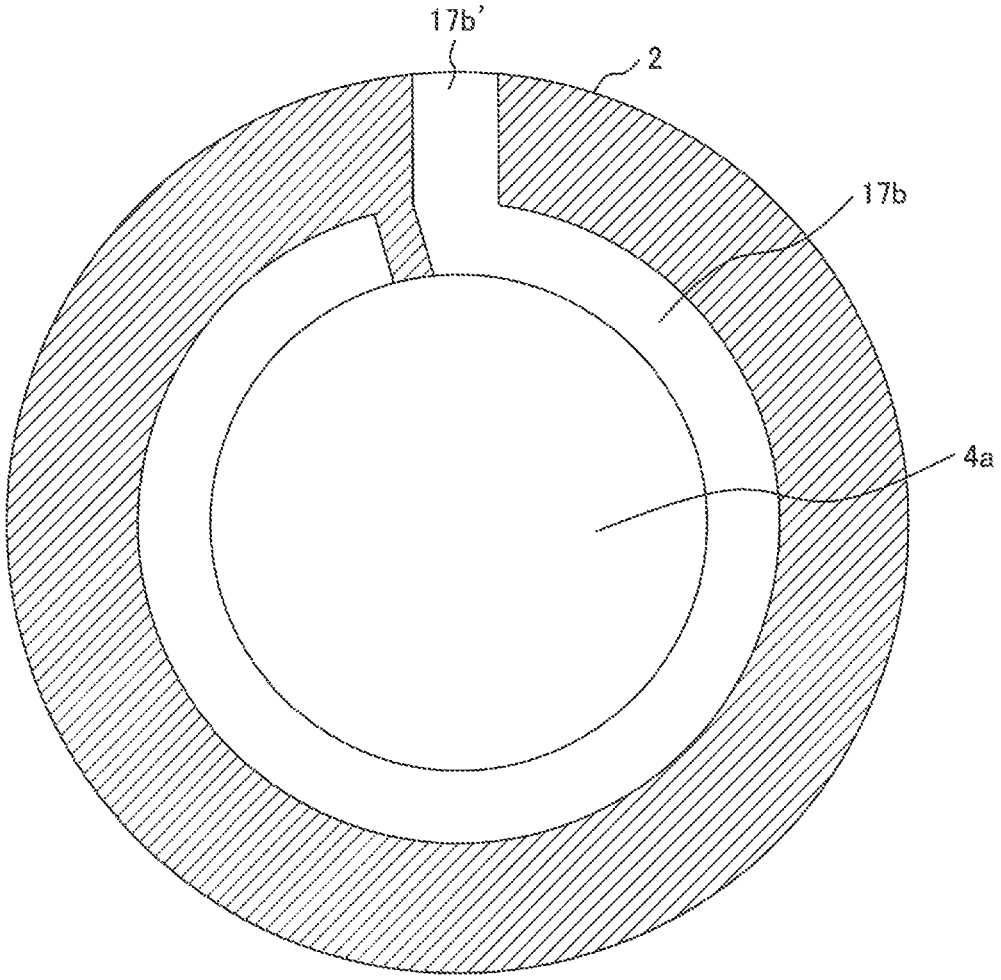
FIG. 2 is a sectional view of the multistage centrifugal fluid machine as shown in FIG. 1 taken along a plane as seen from an arrow A.

FIG. 2 is a sectional view of the multistage centrifugal fluid machine as shown in FIG. 1 taken along a plane as seen from an arrow A, omitting the rotor 3 for convenience of explanation. As FIG. 2 shows, the discharge flow passage 17*b* is formed inside the cylindrical outer casing 2. The compressed working fluid (working gas) is discharged from a discharge port 17*b*' after passing through the discharge flow passage 17*b* as a gap between an outer circumferential surface of an inner barrel member 4*a* and an inner circumferential surface of the outer casing 2.

Figure 3:
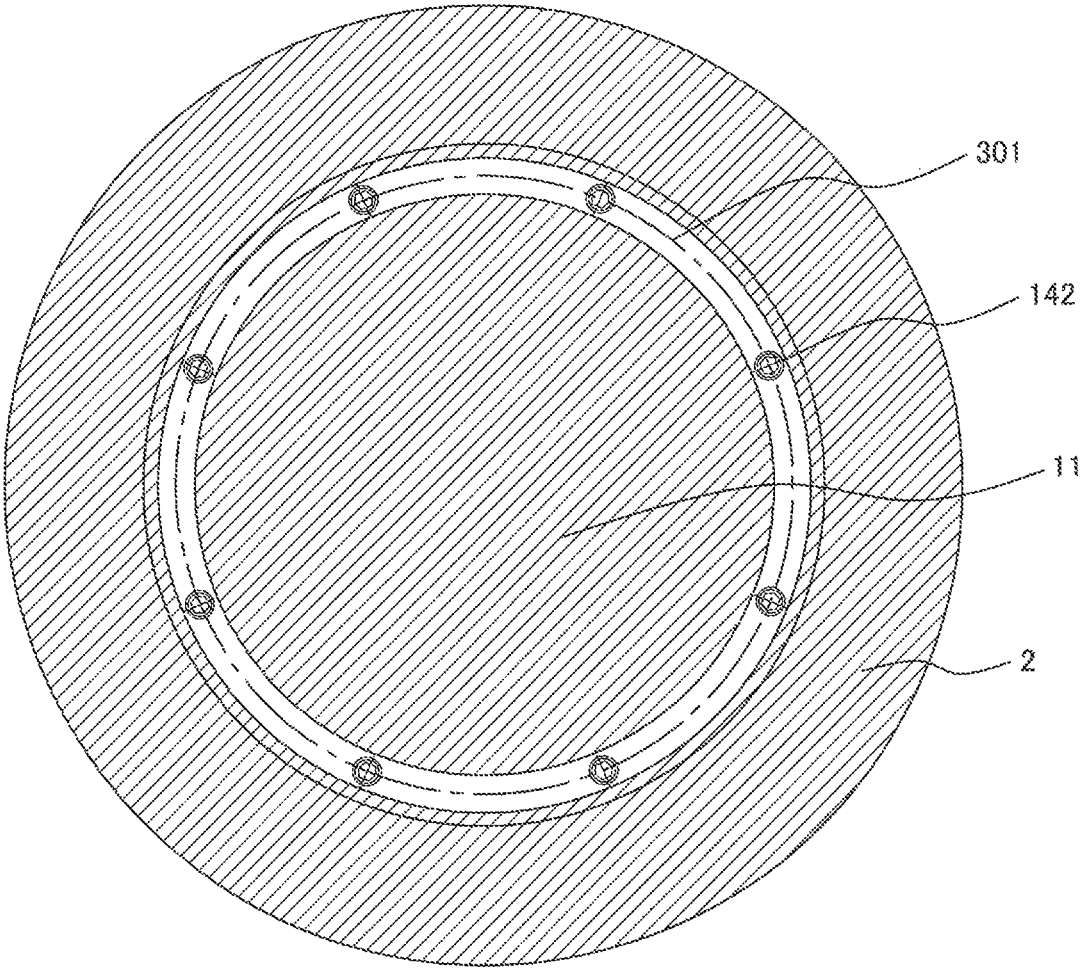
FIG. 3 is a sectional view of the multistage centrifugal fluid machine as shown in FIG. 1 taken along a plane as seen from an arrow B.

FIG. 3 is a sectional view of the multistage centrifugal fluid machine as shown in FIG. 1 taken along a plane as seen from an arrow B, omitting the rotor 3 for convenience of explanation. The high pressure side head flange 11 is disposed at the inner side of the cylindrical outer casing 2. Bolts 142 (first bolt) are disposed at uniform intervals in an annular boundary 301 between the high pressure side head flange 11 and the outer casing 2. The inner casing 5 (not shown in FIG. 3) and the high pressure side head flange 11 are integrated through fastening with the bolts 142 (first bolts).

Figure 4:
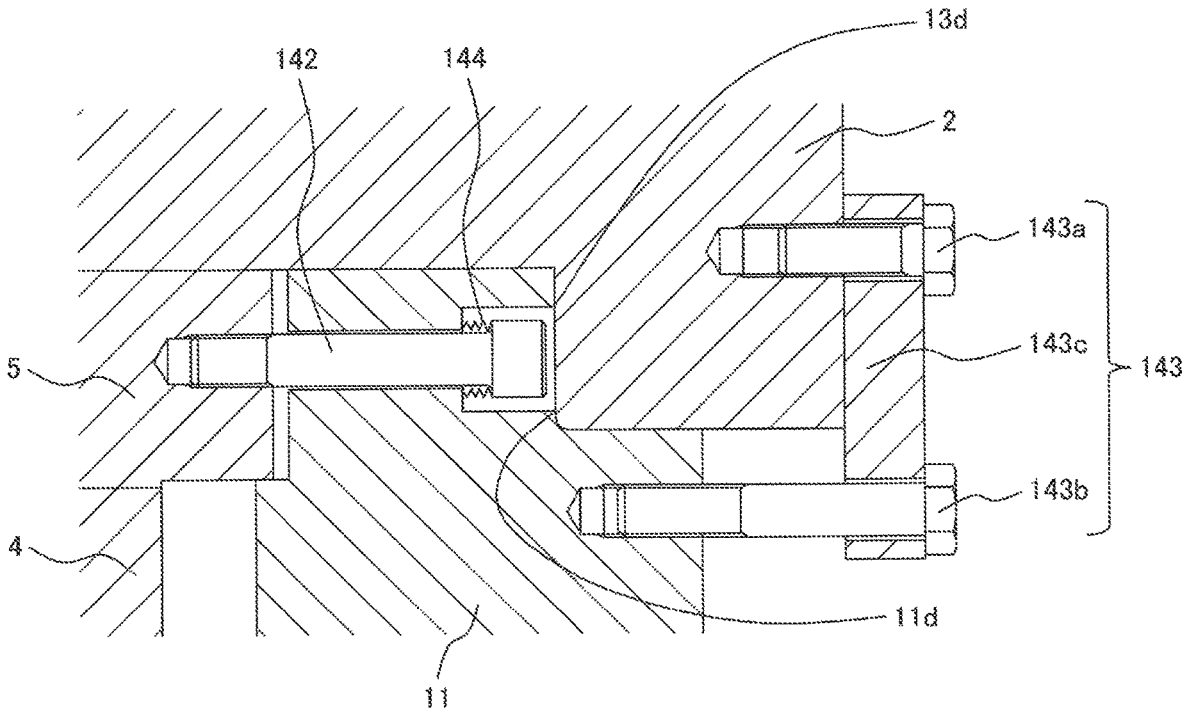
FIG. 4 is an enlarged view of a main part C as shown in FIG. 1.

FIG. 4 is an enlarged view of a main part C as shown in FIG. 1. As FIG. 4 shows, the high pressure side head flange 11 and the inner casing 5 are fastened with the bolt 142 (first bolt). An elastic body 144 interposed between the bolt 142 (first bolt) and the high pressure side head flange 11 is configured to absorb axial displacements of the inner casing 5 and the high pressure side head flange 11.

A plate 143*c* and the outer casing 2 are fastened with a bolt 143*a* (second bolt), and the plate 143*c* and the high pressure side head flange 11 are fastened with a bolt 143*b* (second bolt) below the positioning portion (step) 11*d* (first step) of the high pressure side head flange 11. The bolt 143*a* (second bolt), the bolt 143*b* (second bolt), and the plate 143*c* constitute a holder 143. As described above, the holder 143 constantly maintains the contact state between the outer casing 2 and the high pressure side head flange 11 constituting the inner bundle 1. The inner casing 5 constituting the inner bundle 1 is fastened and fixed to the high pressure side head flange 11 constantly in contact with the outer casing 2 with the bolt 142 (first bolt).

As FIG. 4 shows, the outer casing 2 has the stepped portion (step) 13*d* (second step) on a surface axially opposite the surface that comes in abutment on the plate 143*c* constituting the holder 143. The positioning portion (step) 11*d* (first step) of the high pressure side head flange 11 is formed around the radially outer circumference, that is, around the outer circumferential surface of the cylindrical high pressure side head flange 11 at the side facing the stepped portion (step) 13*d* (second step) of the outer casing 2. A through hole that allows insertion of the bolt 142 (first bolt) is formed around the radially outer circumference of the high pressure side head flange 11 while extending from the positioning portion (step) 11*d* (first step) to the surface facing an axial end of the inner casing 5. A recessed groove larger than an opening of the through hole is formed in the surface of the positioning portion (step) 11*d* (first step) of the high pressure side head flange 11 at the side facing the stepped portion (step) 13*d* (second step) of the outer casing 2.

An end of the elastic body 144 is in contact with a bottom of the recessed groove, and the other end is in contact with a head portion of the bolt 142 (first bolt). The elastic body 144 is configured as a plurality of springs, for example, each having one end in contact with the bottom of the recessed groove formed in the high pressure side head flange 11, and the other end fixed to the head portion of the bolt 142 (first bolt). Those springs are disposed at predetermined intervals to surround the outer circumferential surface of the bolt 142 (first bolt). Alternatively, the elastic body is configured as a bellows-like spring having one end in contact with the bottom of the recessed groove formed in the high pressure side head flange 11, and the other end in contact with the head portion of the bolt 142 (first bolt) to cover a shaft portion of the bolt 142 (first bolt).

For example, a disc spring, a volute spring or the like may be used for the spring as the elastic body 144. It is also possible to use the rubber member embedded with the metal material or the laminated rubber instead of the spring. In such a case, the rubber member embedded with metal material or the laminated rubber may have the Young's modulus similar to that of the disc spring or the volute spring.

Figure 5:
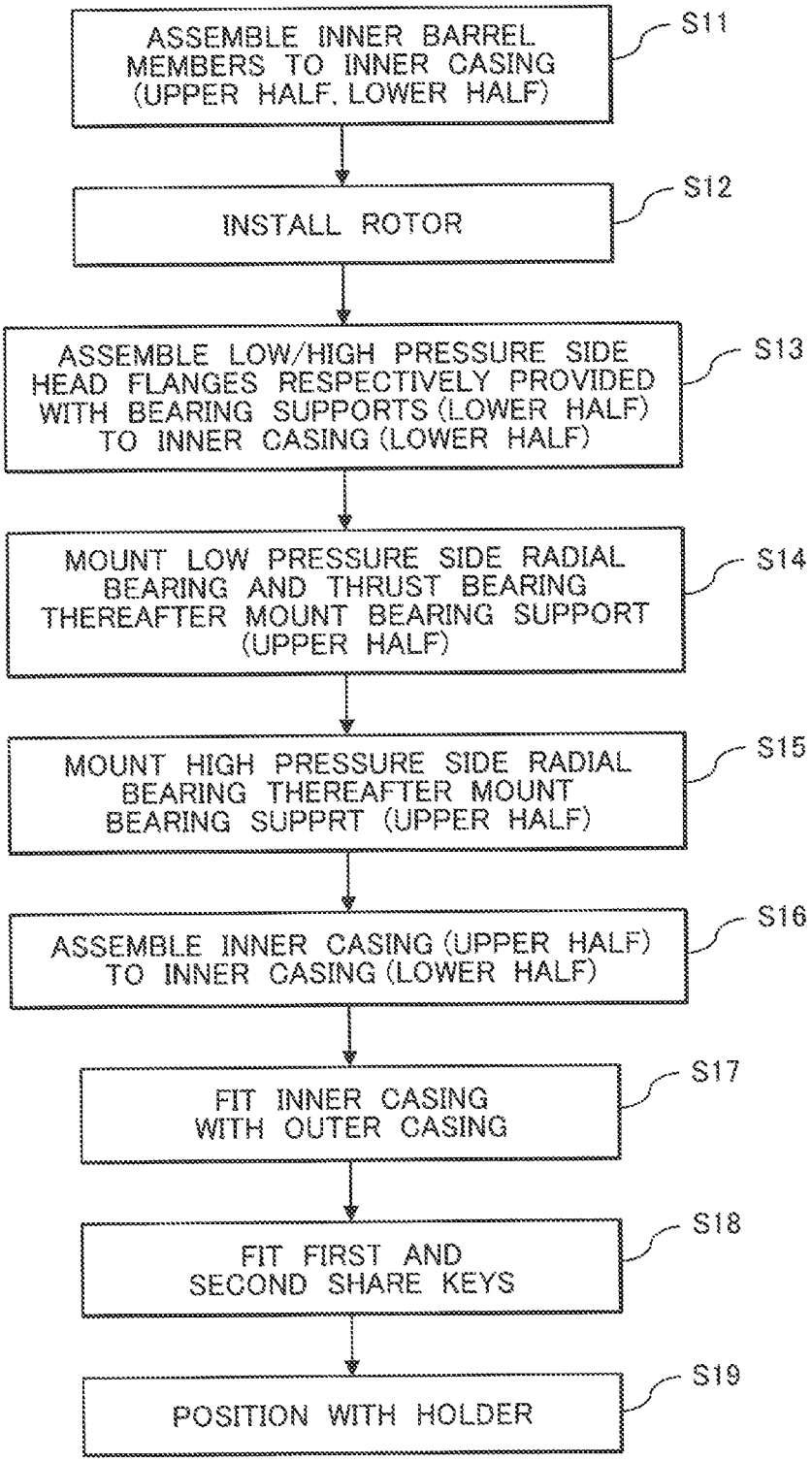
FIG. 5 is a view showing assembly process steps of the multistage centrifugal fluid machine as shown in FIG. 1.

FIG. 5 is a view schematically showing assembly process steps of the multistage centrifugal fluid machine as shown in FIG. 1. An explanation will be made with respect to an assembly procedure in the case of the inner bundle 1 of horizontal two-divided type as an example.

In a first process step (S11), the plurality of inner barrel members 4 are assembled to the inner casing 5 (upper half, lower half) constituting the inner bundle 1.

In a second process step (S12), the rotor 3 is assembled to the inner casing 5 provided with the plurality of the inner barrel members 4.

In a third process step (S13), the bearing support 37 (lower half) is attached to the low pressure side head flange 12, and the bearing support 38 (lower half) is attached to the high pressure side head flange 11. The low pressure side head flange 12 and the high pressure side head flange 11 are then assembled to the inner casing 5 (lower half) provided with the rotor 3.

In a fourth process step (S14), the bearing support 37 (upper half) is mounted after mounting the low pressure side radial bearing 31 and the thrust bearing 36.

In a fifth process step (S15), the bearing support 38 (upper half) is mounted after mounting the high pressure side radial bearing 32.

In a sixth process step (S16), the upper half inner casing 5 is assembled to the lower half inner casing 5.

In a seventh process step (S17), the upper half inner casing 5 and the lower half inner casing 5 which have been assembled in the sixth process step (S16) (hereinafter, the assembly of the upper half inner casing 5 and the lower half inner casing 5 is referred to as a cartridge.) is fitted with the outer casing 2.

In an eighth process step (S18), the first share key 21 and the second share key 22 are installed so that the second share key 22 locks both the groove 14*b* and the stepped portion (step) 12*a*, and the stepped portion (step) 21*a* of the first share key 21 connected to the second share key 22 locks the corner 14*a* of the groove 14*b* of the outer casing 2 as mentioned above.

In a ninth process step (S19), the cartridge is positioned with the holder 143.

As described above, execution of the assembly process steps for the multistage centrifugal fluid machine is finished.

For example, in the sixth process step (S16), when assembling the upper half inner casing 5 assembled with the plurality of inner barrel members 4 to the lower half inner casing 5, the upper half inner casing 5 assembled with the plurality of the inner barrel members 4 heavy in weight has to be pulled up using a crane and the like. It is assumed that the machine disclosed in PTL 1 is subjected to the third process step (S13) where the inner casing 5 (lower half) provided with the rotor 3 is assembled to the low pressure side head flange 12 with the bearing support 37 (lower half), and the high pressure side head flange 11 with the bearing support 38 (lower half). The machine has the inner casing axially divided into two groups, and the connecting member is axially disposed for fitting the groups while having a gap equal to or larger than the manufacturing error kept therebetween. The above-configured machine may cause the backlash, resulting in prolonged time for the assembling operation (mounting operation).

Meanwhile, the structure of the multistage centrifugal fluid machine (multistage centrifugal compressor) 100 of the example allows assembling operation (mounting operation) without causing the backlash owing to the structure as disclosed in PTL 1. The mechanism of the example will be described hereinafter.

Figure 6:
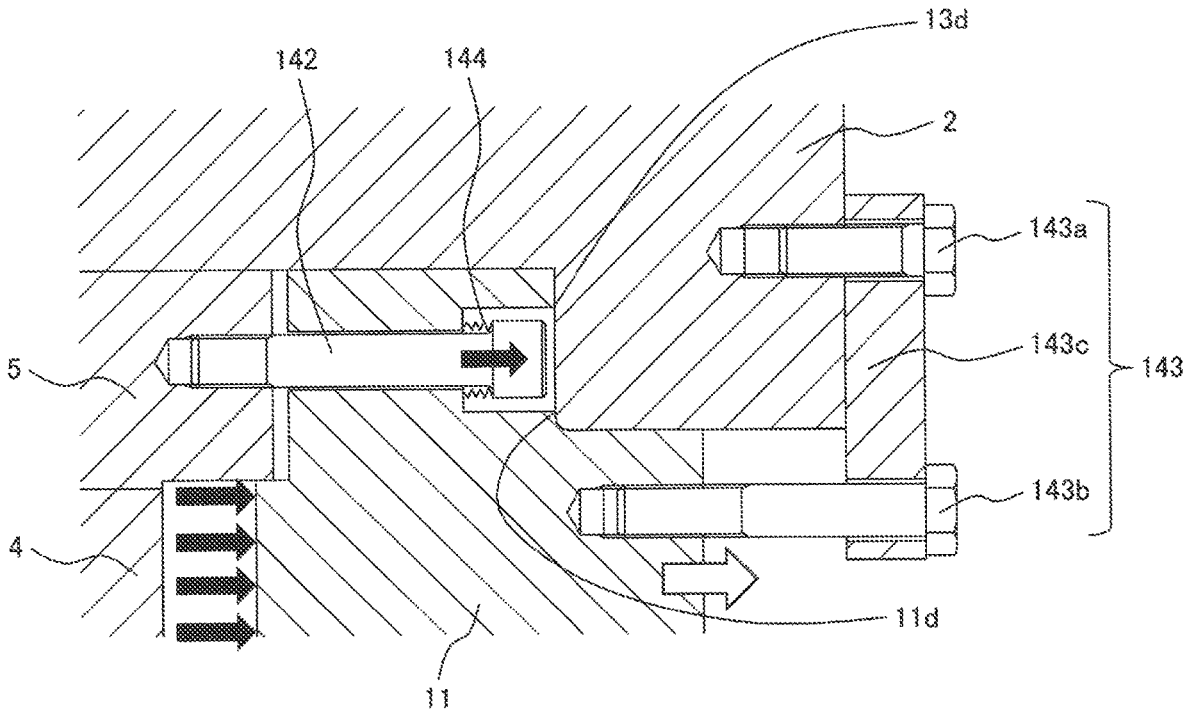
FIG. 6 is an explanatory view of the force acting on each part as shown in FIG. 4.

FIG. 6 is an explanatory view of the force acting on each part as shown in FIG. 4. When assembling the inner bundle 1, the inner casing 5 and the high pressure side head flange 11 are fixed with elastic force of the elastic body 144, and the inner casing 5 and the high pressure side head flange 11 are kept integral. When operating the multistage centrifugal fluid machine (multistage centrifugal compressor) 100, the holder 143 brings the high pressure side head flange 11 into tight contact with the outer casing 2 to bear the axial load (indicated by the void arrow) applied to the high pressure side head flange 11. This makes it possible to prevent excessive load from being applied to the bolt 142 (first bolt). Allowing the gap between the inner casing 5 and the high pressure side head flange 11 which are fastened with the bolt 142 (first bolt) ensures to absorb the processing tolerance of the product in assembling, and the axial displacement of the inner casing 5 in operation.

If, for example, the spring is used as the elastic body 144 as described above, the reactive force of the spring as indicated by the black arrow applied to the bolt 142 (first bolt) as shown in FIG. 6 absorbs the axial displacement or axial load generated in the inner casing 5 and the inner barrel member 4 as indicated by the black arrows in the assembling operation.

The example as described above is capable of providing the multistage centrifugal fluid machine that ensures to improve efficiency in assembling the inner casing with the high pressure side head flange.

In the example, application of the excessive load to the bolt in operation may be prevented.

Example 2

Figure 7:
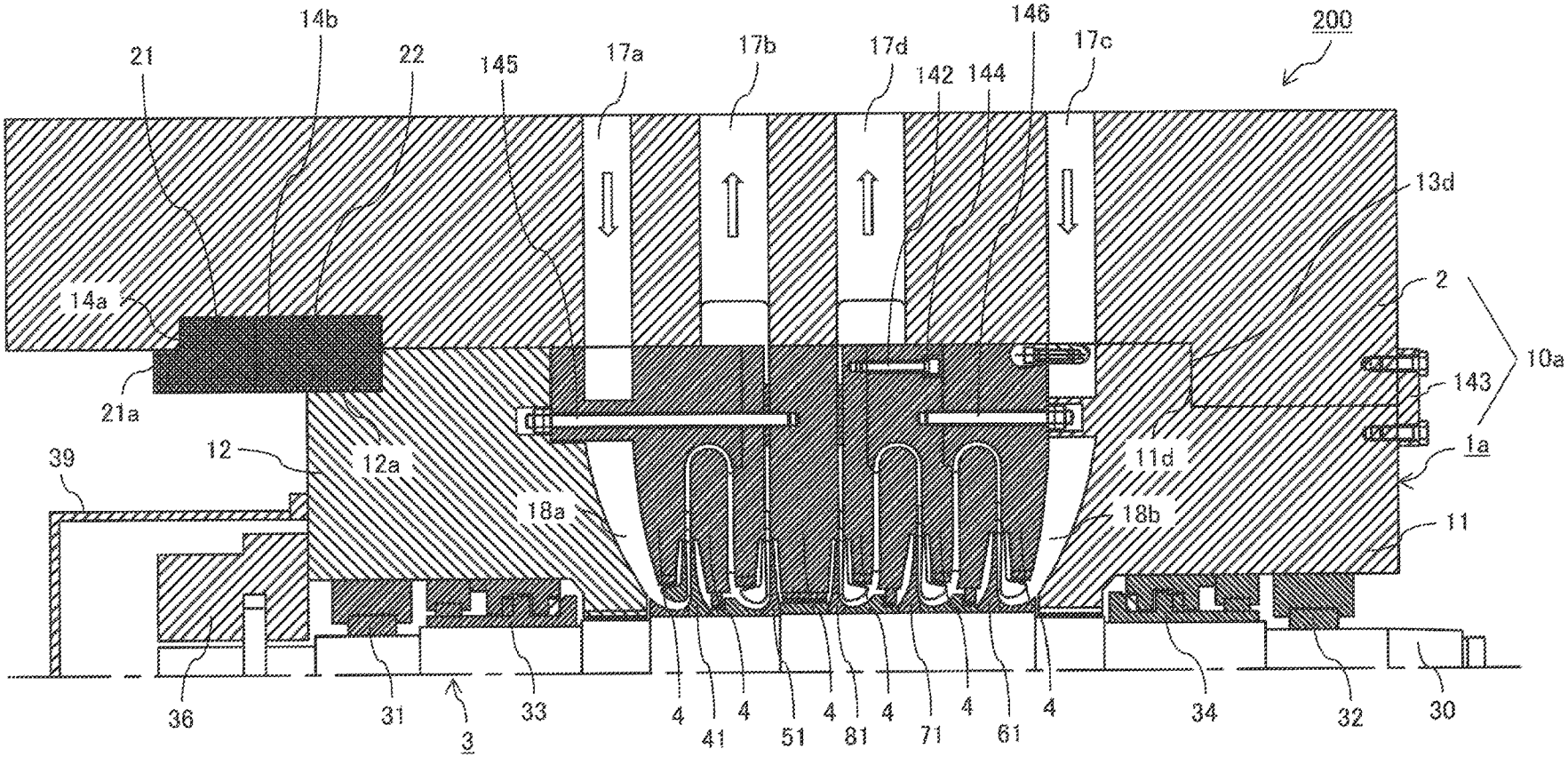
FIG. 7 is a longitudinal sectional view of a multistage centrifugal fluid machine as Example 2 of another embodiment according to the present invention.

FIG. 7 is a longitudinal sectional view of a multistage centrifugal fluid machine 200 as Example 2 of another embodiment according to the present invention. This example is different from Example 1 in that the inner casing is not provided. A plurality of inner barrel members are constituted by first and second group inner barrel members. The first group inner barrel member and the second group inner barrel member axially adjacent to each other are fastened with the bolt 142 (first bolt) via the elastic body 144. The components similar to those of Example 1 will be designated with the same reference signs, and repetitive explanations thereof will be omitted.

Referring to FIG. 7, each of the void arrows indicates the flow direction of the working fluid (working gas). As FIG. 7 shows, the rotary shaft 30 is provided with a plurality of (for example, 5 as shown in FIG. 7) impellers (41, 51, 81, 71, 61) to constitute the rotor 3. The pair of radial bearings 31, 32 are disposed at the respective shaft ends of the rotary shaft 30. The thrust bearing 36 is further disposed closer to the shaft end than the radial bearing 31. The radial bearings 31, 32 rotatably bear the rotary shaft 30. The thrust bearing 36 bears the thrust load applied to the rotor 3. The section closer to the shaft end than the thrust bearing 36 is covered with the cover 39.

The multistage centrifugal fluid machine (multistage centrifugal compressor) 200 configured into a double shell barrel type casing 10*a* includes an inner bundle 1*a* and the outer casing 2. The outer casing 2 has the suction flow passage 17*a* for supplying the working fluid (working gas) from the unshown suction nozzle to the first-stage impeller 41, and the discharge flow passage 17*d* for discharging the compressed working fluid (working gas) outside the multistage centrifugal fluid machine (multistage centrifugal compressor) 200 from the last-stage impeller 81 via an unshown discharge nozzle. Since the impellers in the intermediate stages are disposed while having each back surface facing with each other, the machine further has the discharge flow passage 17*b* for discharging the compressed working fluid (working gas) in the intermediate stages for cooling purpose, and the suction flow passage 17*c* for returning the working fluid (working gas) into the multistage centrifugal fluid machine (multistage centrifugal compressor) 200. The inner bundle 1*a* includes the low pressure side head flange 12 constituting the suction flow passage 18*a* toward the first-stage impeller 41, and the high pressure side head flange 11 constituting the suction flow passage 18*b* toward the intermediate impeller at the respective shaft ends. The inner barrel member 4 is of horizontal two-divided type. The horizontally divided inner barrel member 4 is axially divided into a plurality of sections. The inner barrel member 4 is divided into two groups between the impellers having the respective back surfaces facing with each other. The first group is integrated with a tie-bolt 145, and the second group is integrated with a tie-bolt 146. The holder 143 maintains the contact state between the outer casing 2 and the high pressure side head flange 11 constituting the inner bundle 1*a*.

The inner barrel member 4 closest to the high pressure side head flange 11 in the axial direction among those constituting the first group (hereinafter referred to as first group inner barrel members), and the inner barrel member 4 closest to the low pressure side head flange 12 in the axial direction among those constituting the second group (second group inner barrel members) are fastened with the bolt 142 (first bolt). That is, the bolt 142 (first bolt) fastens the first group inner barrel member and the second group inner barrel member around an end of the discharge flow passage 17*d* of the last-stage impeller 81 constituting the last-stage compressor. The elastic body 144 is disposed between the bolt 142 (first bolt) and the inner barrel 4 disposed at the side of the high pressure side head flange 11, which is adjacent to the inner barrel member 4 closest to the low pressure side head flange 12 in the axial direction among the second group inner barrel members. The elastic body 144 is configured to absorb each axial displacement of the inner barrel member 4 closest to the high pressure side head flange 11 in the axial direction among the first group inner barrel members, and the inner barrel member 4 closest to the low pressure side head flange 12 in the axial direction among the second group inner barrel members.

The inner barrel member 4 closest to the low pressure side head flange 12 in the axial direction among the second group inner barrel members has a through hole which allows insertion of the bolt 142 (first bolt). The inner barrel member 4 closest to the low pressure side head flange 12 in the axial direction among the second group inner barrel members has the recessed groove larger than an opening of the through hole in the surface at the side that faces the adjacent inner barrel member 4 disposed at the side of the high pressure side head flange 11.

Like Example 1, one end of the elastic body 144 is in contact with the bottom of the recessed groove, and the other end is in contact with the head portion of the bolt 142 (first bolt). For example, the elastic body 144 may be a plurality of springs each having one end in contact with the bottom of the recessed groove, and the other end fixed to the head portion of the bolt 142 (first bolt), which are disposed at predetermined intervals while surrounding the outer circumferential surface of the bolt 142 (first bolt). Alternatively, the elastic body may be a bellows-like spring having one end in contact with the bottom of the recessed groove, and the other end in contact with the head portion of the bolt 142 (first bolt), which is disposed to cover the shaft portion of the bolt 142 (first bolt).

For example, the disc spring or the volute spring is used for the spring as the elastic body 144. The rubber member embedded with metal material or the laminated rubber may be used in place of the spring. In this case, the rubber member embedded with metal material or the laminated rubber may have the Young's modulus similar to that of the disc spring or the volute spring.

In the example, the first group inner barrel members fastened with the tie-bolt and the second group inner barrel members fastened with the tie-bolt are fastened with each other with the bolt via the elastic body. It is therefore possible to improve efficiency in the operation for assembling the inner barrel member to the high pressure side head flange.

The present invention is not limited to the examples as described above, but includes various modifications. For example, the examples have been described in detail for readily understanding of the present invention which is not necessarily limited to the one equipped with all structures as described above. It is possible to replace a part of the structure of the example with the structure of another example. The example may be provided with an additional structure of another example.

REFERENCE SIGNS LIST

1, 1*a* . . . inner bundle,
2 . . . outer casing,
3 . . . rotor,
4, 4*a* . . . inner barrel member,
5 . . . inner casing,
10, 10*a* . . . barrel type casing,
11 . . . high pressure side head flange,
11*d* . . . positioning portion (step),
12 . . . low pressure side head flange,
12*a* . . . stepped portion (step),
13*d* . . . stepped portion (step),
14*a* . . . corner,
14*b* . . . groove,
17*a* . . . suction flow passage,
17*b* . . . discharge flow passage,
17*b'* . . . discharge port,
17*c* . . . suction flow passage,
17*d* . . . discharge flow passage,
18*a* . . . suction flow passage,
21 . . . first share key,
21*a* . . . stepped portion (step),
22 . . . second share key,
30 . . . rotary shaft,
31, 32 . . . radial bearing,
33, 34 . . . seal portion,
36 . . . thrust bearing,
37, 38 . . . bearing support,
39 . . . cover,
41, 51, 61, 71, 81 . . . impeller,
100, 200 . . . multistage centrifugal fluid machine (multistage centrifugal compressor),
141 . . . bolt,
142 . . . bolt,
143 . . . holder,
143*a*, 143*b* . . . bolt,
143*c* . . . plate,
144 . . . elastic body,
145, 146 . . . tie-bolt,
301 . . . boundary

The invention claimed is:

1. A multistage centrifugal fluid machine comprising at least a rotor provided with a plurality of impellers in an axial direction, a cylindrical outer casing, and an inner bundle that is fitted with the outer casing to form a flow passage for a working fluid, wherein the inner bundle includes a high pressure side head flange, a low pressure side head flange, and an inner casing disposed between the high pressure side head flange and the low pressure side head flange;

the high pressure side head flange and the inner casing are fastened with a first bolt via an elastic body;

wherein the inner bundle is positioned with respect to the outer casing by contacting a first stepped portion of the high pressure side head flange and a second stepped portion of the outer casing;

the multistage centrifugal fluid machine further comprising a holder having a plate to be fastened to an end surface of the outer casing opposite the second stepped portion, and to the high pressure side head flange below the first stepped portion using a second bolt;

wherein the high pressure side head flange includes a through hole formed in the first stepped portion to allow insertion of the first bolt.

2. The multistage centrifugal fluid machine according to claim 1, wherein the elastic body is a spring;

the high pressure side head flange has a recessed groove that is larger than an opening of the through hole in a surface of the through hole facing the second stepped portion; and the spring has one end in contact with a bottom of the recessed groove, and the other end fixed to a head portion of the first bolt.

3. The multistage centrifugal fluid machine according to claim 2, wherein a plurality of springs are disposed at predetermined intervals on an outer circumferential side of the first bolt.

4. The multistage centrifugal fluid machine according to claim 3, comprising a share key for fixing the outer casing to the low pressure side head flange.

5. The multistage centrifugal fluid machine according to claim 2, wherein an outer circumferential surface of the head portion of the first bolt is surrounded by the high pressure side head flange.

6. The multistage centrifugal fluid machine according to claim 1, wherein the elastic body is a bellows-like member;

the high pressure side head flange has a recessed groove that is larger than an opening of the through hole on a surface of the through hole facing the second stepped portion; and the bellows-like member has one end in contact with a bottom of the recessed groove, and the other end in contact with a head portion of the first bolt.

7. The multistage centrifugal fluid according to claim 6, wherein the bellows-like member is disposed to cover a shaft portion of the first bolt.

8. The multistage centrifugal fluid machine according to claim 7, wherein the bellows-like member is any one of a disc spring, a volute spring, a rubber member embedded with metal material, and a laminated rubber.

9. The multistage centrifugal fluid machine according to claim 7, comprising a share key for fixing the outer casing to the low pressure side head flange.

* * * * *